US005393344A

United States Patent [19]

Oyagi et al.

[11] Patent Number: 5,393,344

[45] Date of Patent: Feb. 28, 1995

[54] APPARATUS FOR MOLTEN METAL PLATING

[75] Inventors: Yashichi Oyagi; Hirofumi Nakano, both of Futtsu, Japan

[73] Assignee: Nippon Steel Corporation, Tokyo, Japan

[21] Appl. No.: 195,465

[22] Filed: Feb. 14, 1994

Related U.S. Application Data

[62] Division of Ser. No. 866,866, Apr. 10, 1992, Pat. No. 5,308,659.

[30] Foreign Application Priority Data

Apr. 25, 1991 [JP] Japan ..... 3-95337
Apr. 25, 1991 [JP] Japan ..... 3-95338

[51] Int. Cl.[6] ..... B05C 21/00

[52] U.S. Cl. ..... 118/244; 118/63; 118/259; 118/266; 427/432

[58] Field of Search ..... 118/244, 259, 266, 63; 427/349, 428, 430.1, 434.3, 432, 433

[56] References Cited

U.S. PATENT DOCUMENTS 3,201,275 8/1965 Herrick ..... 427/109
3,799,111 3/1974 Damrau ..... 118/63
4,239,817 12/1980 Koenitzer et al. ..... 427/211
4,374,873 2/1983 Piedboeuf et al. ..... 427/349
4,811,661 3/1989 Maruta ..... 118/63
4,871,593 10/1989 McIntyre ..... 118/259
5,072,689 12/1991 Nakagawa et al. ..... 118/419

FOREIGN PATENT DOCUMENTS 59-67357 4/1984 Japan .
1207555 9/1986 Japan .
1235550 10/1986 Japan .

*Primary Examiner*—W. Gary Jones
*Assistant Examiner*—Laura E. Edwards
*Attorney, Agent, or Firm*—Wenderoth, Lind & Ponack

[57] ABSTRACT

A method of molten metal plating, comprising the steps of: bringing a travelling steel strip into contact with a revolving roll; applying a molten metal on the roll through a nozzle disposed near the roll; and transferring the applied molten metal from the roll to the steel strip by the revolution of the roll. An apparatus for molten metal plating, comprising: a coating roll capable of being brought into contact with a travelling steel strip; a nozzle disposed near the roll for applying a molten metal on the roll; and a source for supplying a molten metal to the nozzle.

3 Claims, 7 Drawing Sheets

WITHOUT GAS EJECTION

GAS EJECTION USED

△ ▲ ··· A

○ ● ··· B

NOTE: DISTRIBUTION ALONG ROLL WIDTH OF APPLIED MOLTEN METAL AMOUNT CONTROLLED IN "B" AND NOT CONTROLLED IN "A"

NOTE 1: MOLTEN METAL ON ROLL SURFACE

× — THOROUGHLY SPLASHED

△ — PARTIALLY SPLASHED

○ — TRACE SPLASHED

● — NO SPLASH

□ — SOLIDIFIED ON ROLL SURFACE

NOTE 2: ΔT = (ROLL SURFACE TEMPERATURE) − (MELTING POINT OF MOLTEN METAL)

APPARATUS FOR MOLTEN METAL PLATING

This is a Divisional application of Ser. No. 07/866,866, filed Apr. 10, 1992, now U.S. Pat. No. 5,308,659.

BACKGROUND OF THE INVENTION

1. Field of the Invention

The present invention relates to a method of molten metal plating and an apparatus therefor.

Steel strips plated with Zn, Al, Sn, or Pb or alloys thereof are widely applied for automobiles, architecture, electric equipment, and cans and improved quality and production efficiency is desired.

2. Description of the Related Art

A conventional method of molten metal plating comprises: heating a steel strip in a reducing atmosphere to clean the surface thereof; directing the strip into a bath of a molten metal to be deposited; lifting the strip deposited with the metal out of the bath; and then immediately subjecting the strip to a gas sprayed from a slit-shaped nozzle to remove an excess deposit metal and thereby control the deposited metal amount. Another conventional method brings a steel strip into contact with a molten metal only on one side thereof and the deposited metal amount is controlled in the same way.

This hot-dip plating is applied in the production of blank materials currently widely used, typically in Zn-plating, Al-plating, and turn plating.

The hot-dip plating has a disadvantage in that a strip is partially dissolved in a plating bath when the strip passes through the bath and most of the dissolved iron from the strip forms an intermetallic compound with the bath components and floats in the bath as a floating dross. The dross is entrained in the plated layer during plating process and degrades the appearance, corrosion resistance and formability of a plated product.

Another disadvantage is the plating bath which must have a large volume sufficient to introduce and dip a steel strip therein by using a pot roll. To change the composition of such a large volume of plating bath, particularly when the kind of product is to be changed, it is necessary to bail out part of the bath and replenish or add a plating metal or an additive metal. This requires a lot of cost, time and labor and only a limited kind of product can be processed in the same plating line.

Another disadvantage is that dipping requires a long time causing a reaction between a steel strip and a plating metal to form a thick brittle alloy layer which impairs the formability of the plated product. Additives are fed to the plating bath to reduce the thickness of the alloy layer, but this measure becomes insufficient when the plated products are subjected to heavier forming.

Moreover, the ambient atmospheric oxygen reacts with the molten metal to generate an oxidized dross causing an undesirable consumption of the metal bath, depositing on the strip surface and thereby imparing the product appearance.

The most general method of controlling the deposited metal amount is the above-mentioned gas spray. When a line speed is 160 m/min or higher, the excess metal removed from a steel strip violently splashes and adheres again to the strip, and the amount of metal lifted by the strip and the amount of generated dross are also increased. The line speed is therefore limited.

To solve the above-mentioned problems, U.S. Pat. No. 3,201,275 proposed a method in which a resin solution is sucked up by capillarity from a level lower than a coating nozzle to form a meniscus of the solution on the coating nozzle and the meniscus is brought into contact with a tape to apply the solution on the tape. When this method is used in molten metal plating, the following problems arise. To ensure a satisfactory suction of a molten metal by capillarity, a suction pipe must be made of a material having a good wettability with the molten metal. Such a material, however, also easily reacts with the molten metal and thereby causes contamination of the molten metal during the suction and blockage of the pipe. Moreover, a molten metal has a specific gravity greater than that of a resin solution and is difficult to suck stably, with the result that when the travelling speed of a metal strip is high the molten metal supply is insufficient to ensure a good coating. The high speed travelling of a metal strip also has a problem in that the ambient gas, dragged by the travelling strip, collides with the meniscus at a high speed and is engulfed in the meniscus, to cause the formation of a discrete coating which is not practically applicable.

Japanese Unexamined Patent Publication (Kokai) No. 61-207555 proposed a method capable of solving the above-mentioned problem of an insufficient supply of a molten metal, in which method a meniscus of a molten metal is formed on the outlet opening of a nozzle and a metal strip is brought into contact with the meniscus while travelling. This increases the outflow of the molten from the outlet opening in comparison with an outflow of a metal freely flowing out of the opening and the deposited metal amount can be easily controlled. This increase in outflow is caused by the wetting adhesion of the molten metal to the strip and the deposited metal amount is controlled to a constant value in accordance with the travelling speed of the metal strip. When the control of the deposited metal amount is effected by adjusting the distance between the nozzle outlet opening and the metal strip, there is a tendency for the deposited metal amount to abruptly change at a certain value of the distance and does not significantly vary at distances greater or smaller than this value. To ensure stable control, the distance need be set at a value not causing a significant change in the deposited metal amount, and therefore, a desired deposited metal amount is not always obtained.

To solve this problem, Japanese Unexamined Patent Publication (Kokai) No. 61-235550 proposed a method in which a dam is provided within the opening of a plating nozzle to provide a constant gap at the dam and partially close the opening or decrease the sectional area for the passage of a molten metal, whereby the amount of sucked molten metal is controlled. Specifically, the dam is composed of a plurality of members respectively slidable in the gap-ward direction and part of the members are moved down towards the gap at a constant interval.

This method, however, has a disadvantage in that the flowout speed is difficult to control precisely and uniformly over the width of a metal strip to be plated and that the nozzle gap of 0.6 mm varies because of thermal distortion, etc., to cause a non-uniform deposited metal amount over the strip width, which cannot be restored by any means. Therefore, this method cannot be applied to practical use. Likewise in the previously recited U.S. Pat. No. 3,201,275, the high speed travelling of a metal strip also has a problem in that the ambient gas, dragged by the travelling strip, collides with the meniscus at a high speed and is engulfed in the meniscus, to cause the formation of a discrete coating which is not practically applicable.

Japanese Unexamined Patent Publication (Kokai) No. 59-67357 disclosed a method based on a production process of amorphous ribbons, in which a molten metal is sprayed on a travelling steel strip, instead of a rotating disc, either through a slit-shaped nozzle or a multiple opening nozzle and the sprayed molten metal is cooled by the steel strip to form a metal coating on the strip. Specifically, a vessel containing a molten metal and having a slit-shaped nozzle or a multiple opening nozzle, is disposed above a steel strip travelling on a drum, with the nozzle tip being close to the strip, usually at a distance of not more than 1 mm. The flowout speed of the molten metal is controlled either by the level of the nozzle head or by a pressure of an inert gas such as argon.

This method also has a problem in that a non-uniform flowout speed over the strip width directly causes a non-uniform deposited metal amount over the strip width and a widthwise control of the flowout speed is essentially important to ensure a uniform plating over the strip width, but such a control is not disclosed for practical application. Likewise in the previously recited methods, the high speed travelling of a metal strip also has a problem in that the ambient gas, dragged by the travelling strip, collides with the meniscus at high speed and is engulfed in the meniscus, to cause the formation of a discrete coating which is not practically applicable, and therefore the travelling speed is limited.

This problem due to the high travelling speed is also experienced in the extrusion of a molten resin by "T-die" process, and in the same manner as in this process, the ambient atmospheric gas may be evacuated to provide a vacuum. In a continuous production line, however, expensive equipment such as a differential evacuation system is required and the evacuation capacity must be increased when using a high travelling speed, which cannot practically be applied.

The above-recited conventional methods commonly have the following problems.

A problem arises when a metal strip is plated on both sides thereof. In a method in which a fluctuation of the strip passage line, including the vibration of a travelling strip, is suppressed by support rolls and the strip is plated first on one side and then on the other side by using a nozzle disposed near the strip, the side to be later plated is brought into contact with the support rolls upon plating. In molten metal plating processes, a steel strip is maintained at a temperature near the melting point of a plating metal, and therefore, the metal deposited on the first side of the strip is in a molten or semi-molten state and the contact with the support rolls causes a non-uniform appearance and quality.

Another problem resides in continuous productivity. Continuous production requires that strip coils be bonded with each other by welding, the welded joint has an uneven profile along the strip width due to thermal distortion and collides with the plating nozzle disposed near the strip. The collision may be avoided by retreating the nozzle, but it is not actually possible to move the nozzle at a precision of several to several tens of micrometers together with the associated heavy equipment including a molten metal pot, a runner, etc. Moreover, a steel strip to be plated may not have a flat shape but may have corrugations across the width or length of the strip. Such a strip shape also makes it difficult to stably maintain a constant distance between the strip and a plating nozzle.

SUMMARY OF THE INVENTION

The object of the present invention is to solve the above-mentioned problems of the conventional methods.

To achieve the object according to the present invention, there is provided a method of molten metal plating, comprising the steps of:

bringing a travelling steel strip into contact with a revolving roll;

applying a molten metal on the roll through a nozzle disposed near the roll; and transferring the applied molten metal from the roll to the steel strip by the revolution of the roll.

According to the present invention, there is also provided an apparatus for molten metal plating, comprising:

a coating roll capable of being brought into contact with a travelling steel strip;

a nozzle disposed near the roll, for applying a molten metal on the roll; and means for supplying a molten metal to the nozzle.

In one aspect of the present invention, a nonoxidizing gas is ejected from a nozzle toward the roll.

In another aspect of the present invention, the nozzle has a slit for ejecting the molten metal and the nozzle is disposed in such a manner that a corner of an outlet opening of the slit, which corner is located on the downstream side of the roll revolution direction, is nearest the roll surface.

In another aspect of the present invention, the temperature of the roll surface is controlled at a temperature not higher than the melting point of the molten metal.

DESCRIPTION OF THE PREFERRED EMBODIMENTS

According to the present invention, a steel strip can be plated on both sides thereof and plating can be successfully carried out even for a strip joint and a strip having an uneven surface.

When a steel strip travelles at high speed and the ambient gas dragged by the travelling strip is engulfed by a molten metal meniscus between a coating roll and a plating nozzle, a gas ejecting opening, provided in the nozzle at a downstream portion thereof with respect to the revolution direction of the coating roll, ejects a gas toward the roll to support the molten metal meniscus against the pressure of the dragged gas.

When this cannot sufficiently ensure that the molten metal ejected from a slit of the plating nozzle is applied on the roll surface uniformly over the roll width, the nozzle is disposed so that a nozzle slit edge, located downstream with respect to the roll revolution direction, is nearest the roll surface to provide a uniform application of the molten metal on the roll surface.

When the coating roll revolution speed is further increased with an increase of the strip travelling speed and the molten metal applied on the roll surface splashes away, the roll is maintained at a temperature not higher than the melting point of the molten metal.

Figure 1:
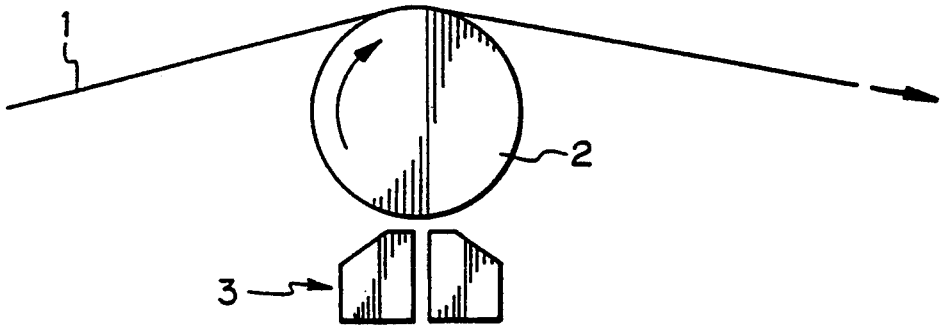
FIG. 1 schematically illustrates an arrangement for carrying out a molten metal plating by using a coating roll, in which a gas ejection is not used.

In FIG. 1, a steel strip 1 is brought into contact with a coating roll 2, a nozzle 3 is disposed near the coating roll 2, a molten metal of Zn, Al, Sn or Pb or an alloy thereof is supplied to the nozzle 3, the molten metal is applied on the coating roll 2, and the applied molten metal is then transferred from the roll 2 to the strip 1. At least the rolling surface of the coating roll 2 is coated with an oxide-, carbide- or nitride-base ceramics material having a resistance to erosion by the molten metal. When the roll surface has poor wettability with the molten metal, the coating roll 2 is controlled at a temperature not higher than the melting point of the molten metal to prevent the occurrence of a molten metal from splashing under a high speed revolution of the roll. This will be described in detail later.

The gap between the tip opening of the nozzle 3 and the coating roll 2 is usually 1 mm or less, preferably 0.5 to 0.1 mm. When the gap is greater than 1 mm, the molten metal ejected from the nozzle 3 forms stripes or streaks when applied on the roll 2 and causes a streaky deposition on a steel strip, with the result that the product strip is not practically applicable. A gap of 0.5 mm or less provides the most uniform appearance of the plated surface. A gap less than 0.1 mm is difficult to be constantly maintained over the strip width because of thermal distortion at high temperature and mechanical vibration and thereby results in a streaky appearance of the plated strip.

The molten metal ejection speed is controlled by static pressure such as a head pressure of the molten metal and a pressurized non-oxidizing gas, for example, nitrogen gas. The nozzle 3 is provided with an opening in the form of a slit or a plurality of holes for ejecting the molten metal. The slit width or the hole diameter has a size of 0.3 to 3 mm. When the size is smaller than 0.3 mm, the ejection of the molten metal is unstable and pulsating. When the size is greater than 3 mm, the distance between the coating roll 2 and the tip of the nozzle 3 must be 0.1 mm or less to control the deposited metal amount. Such a small distance impairs the appearance of the plated surface.

To ensure a uniform appearance of the plated surface over the strip width, the following conditions are further required.

Figure 2:
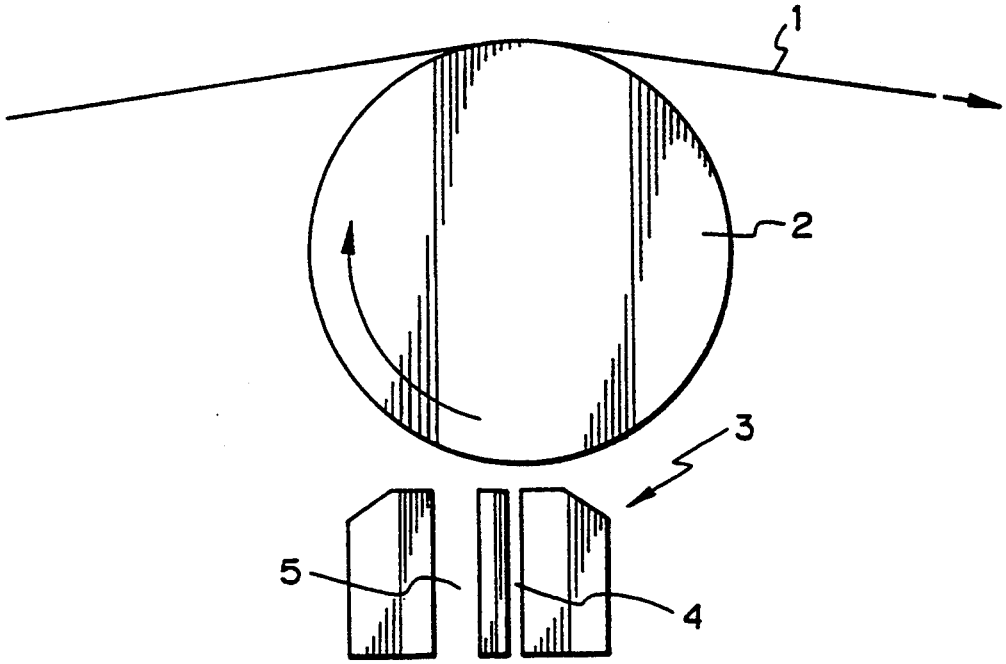
FIG. 2 schematically illustrates an arrangement for carrying out a molten metal plating by using a coating roll, in which a gas ejection is used.

As shown in FIG. 2, an opening 5 in the form of a slit or a plurality of holes for ejecting a non-oxidizing gas is provided in a nozzle 3 in the portion downstream of the nozzle opening 4 with respect to the revolution direction of a coating roll 2.

The slit 5 continuously extends in the strip width direction within the nozzle 3 and is partitioned in the strip travel direction or composed of a plurality of subslits either in the entire length of the slit 5 to facilitates the separate control of the ejected gas pressure for respective subslits or in the portion other than the exit region of the slit 5 to facilitate the general control of the ejected gas pressure. The plurality holes 5 are arranged along the strip width direction and the ejected gas pressures are controlled separately from each other. The gas ejection provides the following effect.

Figure 3:
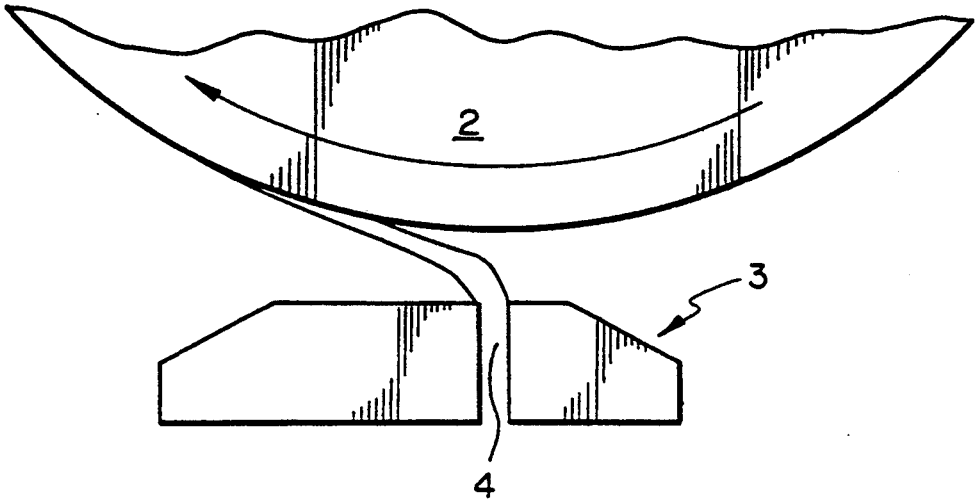
FIG. 3 shows a molten metal meniscus formed when a gas ejection is not used.

FIG. 3 shows an arrangement in which a gas ejection is not carried out. The ambient atmospheric gas dragged by a revolving coating roll 2 collides against a molten metal meniscus to elongate the meniscus downstream in the direction of the roll revolution and is engulfed by the elongated meniscus, and whereby it becomes difficult to provide a meniscus continuously extending over the strip width.

Figure 4:
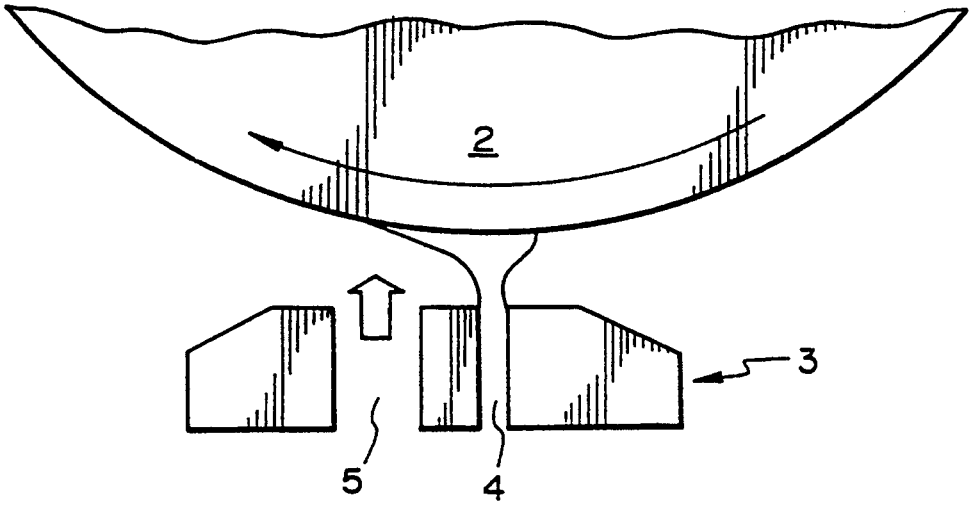
FIG. 4 shows a molten metal meniscus formed when a gas ejection is used.
Figure 5A:
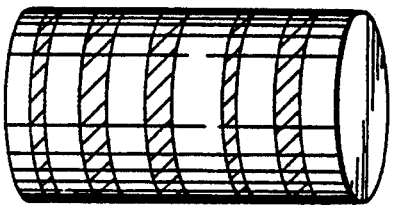
FIGS. 5(*a*) and 5(*b*) show a molten metal applied on a coating roll when a gas ejection is not used (a) or is used (b)
Figure 5B:
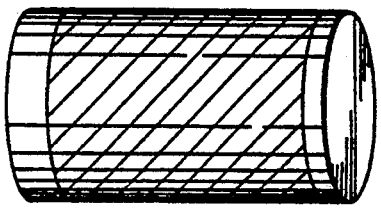

FIG. 4 shows an arrangement in which a gas ejecting is carried out. The gas ejected from the gas ejecting opening 5 acts upon a molten metal meniscus against the pressure due to the collision of the dragged gas to prevent the dragged gas from being engulfed by the molten metal meniscus, and thereby ensure the provision of a molten metal meniscus continuously extending over the strip width, and consequently, provide a uniform appearance of the plated surface over the strip width. FIG. 5(*b*) schematically illustrates the thus-obtained uniform application of a molten metal over the roll width.

Figure 6:
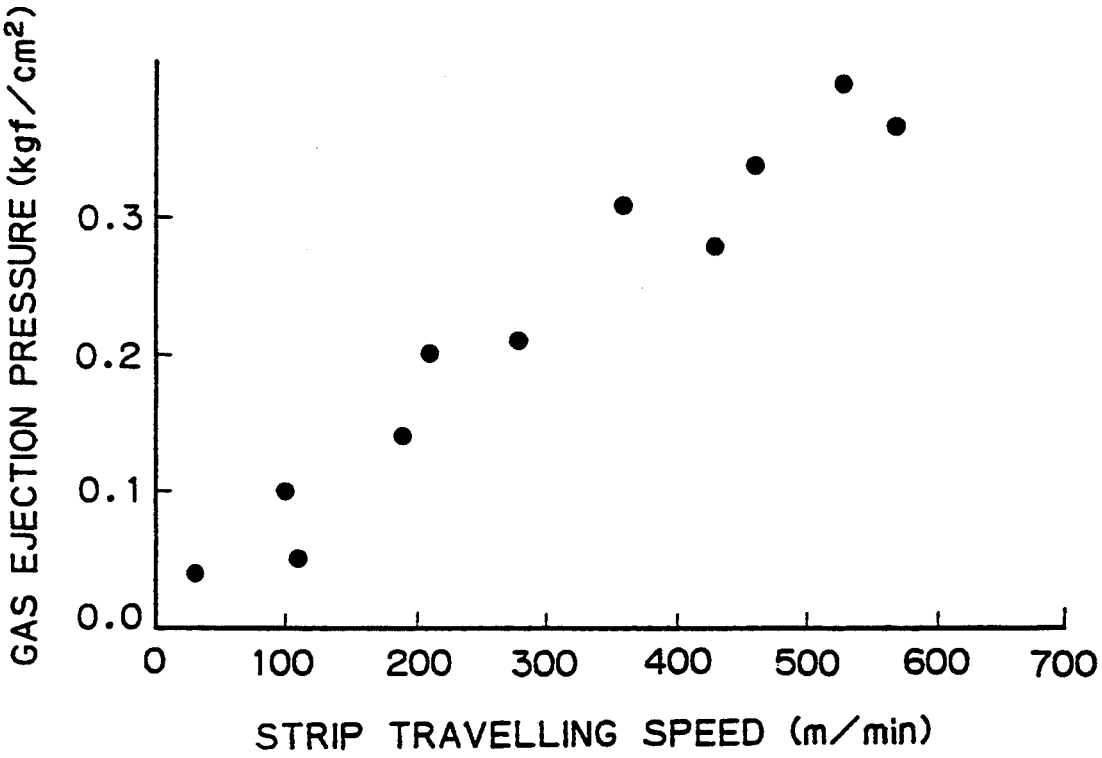
FIG. 6 is a graph showing the relationship between the gas ejection pressure and the steel strip travelling speed to provide a uniformly spreaded coating.

The higher the gas ejection pressure (or head pressure), the higher the maximum roll periphery speed providing a uniform application of a molten metal on the roll surface, as can be seen from FIG. 6.

Figure 7:
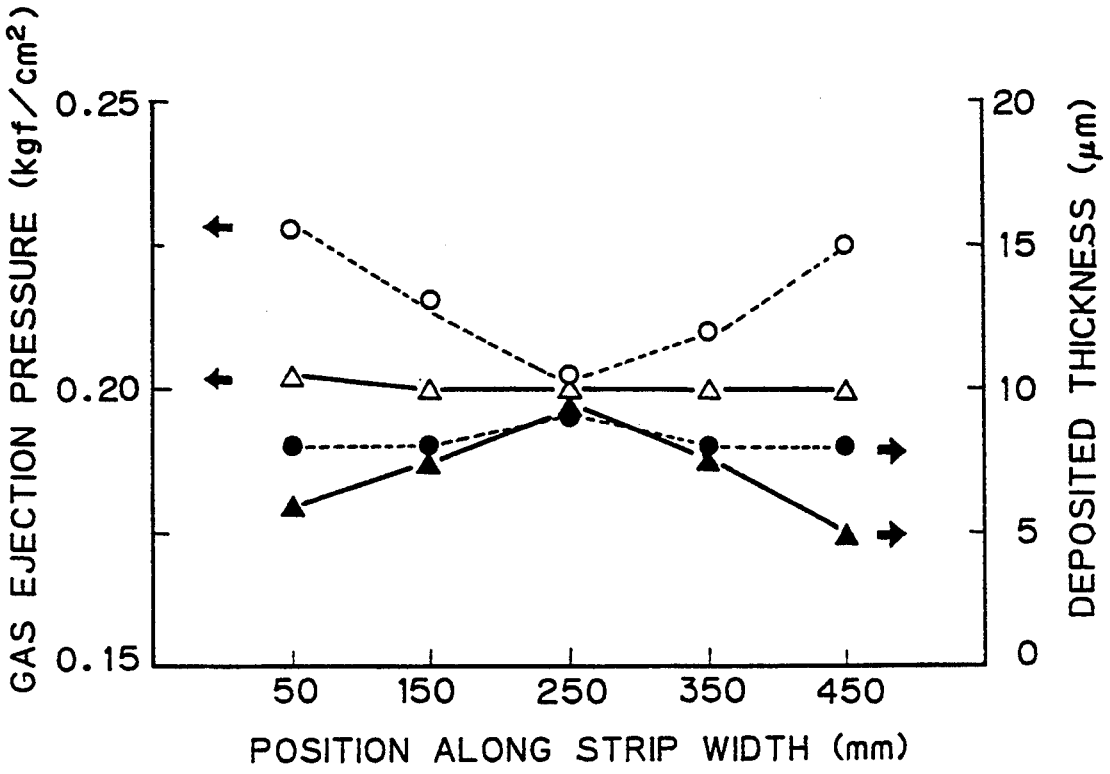
FIG. 7 is a graph showing the relationship between the gas ejection pressure and the distance along the steel strip width.

The deposited metal amount on a steel strip also fluctuates along the strip width when the gap between the strip and a nozzle fluctuates because of thermal distortion of the nozzle. This fluctuation can be cancelled in a manner such that the non-oxidizing gas ejection opening 5 of a nozzle 3 is partitioned along the strip width to provide a plurality of gas passages and the gas ejection pressures of respective passages are controlled independently from each other, to provide a desired distribution of the deposited metal amount over the strip width, as can be seen from FIG. 7.

In some cases, even when the above-mentioned conditions are satisfied, the molten metal ejected from a nozzle forms stripes on a coating roll 2. In this case, the gap between a nozzle slit and the coating roll 2 must be controlled taking the following conditions into consideration.

Figure 8A:
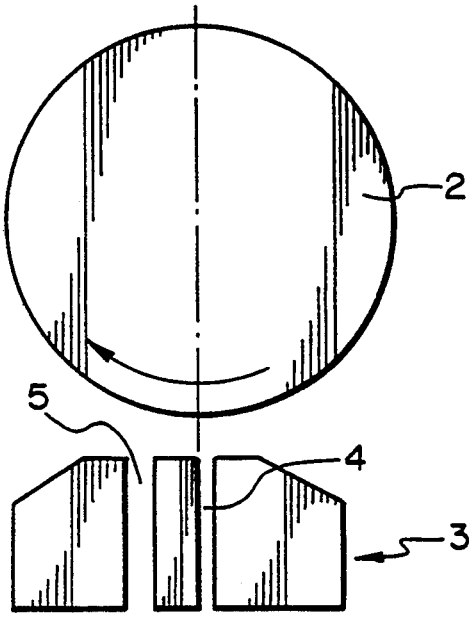
FIGS. 8(*a*) and 8(*b*) show two arrangements of a nozzle and a coating roll in which (a) a nozzle slit edge, located downstream with respect to the roll revolution direction, is nearest the roll surface and (b) a nozzle slit edge, located upstream with respect to the roll revolution direction, is nearest the roll surface.
Figure 8B:
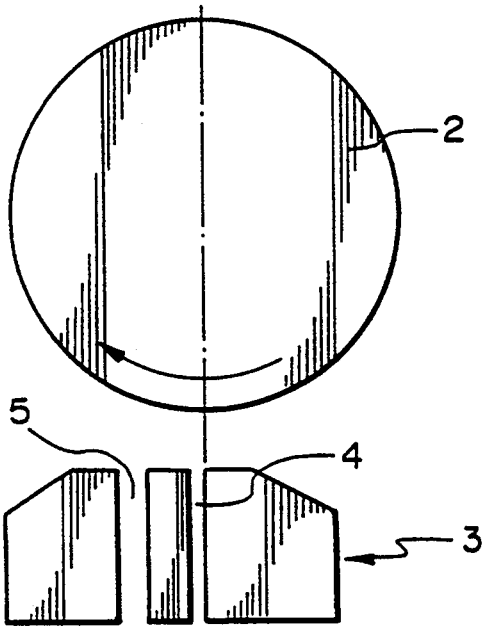

A molten metal can be uniformly applied on the roll surface over the roll width (which corresponds to the strip width), when a nozzle is disposed so that a nozzle slit edge located downstream with respect to the roll revolution direction is nearest the roll surface, as shown in FIG. 8(*a*). Molten metal stripes are formed on the coating roll surface, when a nozzle is disposed so that a nozzle slit edge located upstream with respect to the roll revolution direction is nearest the roll surface, as shown in FIG. 8(*b*).

This means that the gap between the roll surface and the nozzle slit must be set in terms of a gap of the position at which a molten metal finally leaves the nozzle slit, i.e., the position at which the roll surface begins to move away from the plane defined by the exit portion of the nozzle slit.

To control the deposited metal amount, it is also possible to use a coating roll provided with a number of fine dimples on the roll surface, such as provided in a gravure roll, so that a molten metal is received in the dimples and then transferred to the strip surface.

As previously mentioned, at least the rolling surface of a coating roll 2 should be made of a ceramics material from the viewpoint of the service life of the roll. A ceramics material advantageously has low reactivity with a molten metal but simultaneously has poor wettability with a molten metal. Even when the preceding conditions are satisfied, a poor wettable roll surface causes a molten metal, once uniformly applied, to be repelled by the roll surface to consequently provide a non-uniform deposition on the strip surface.

Figure 9:
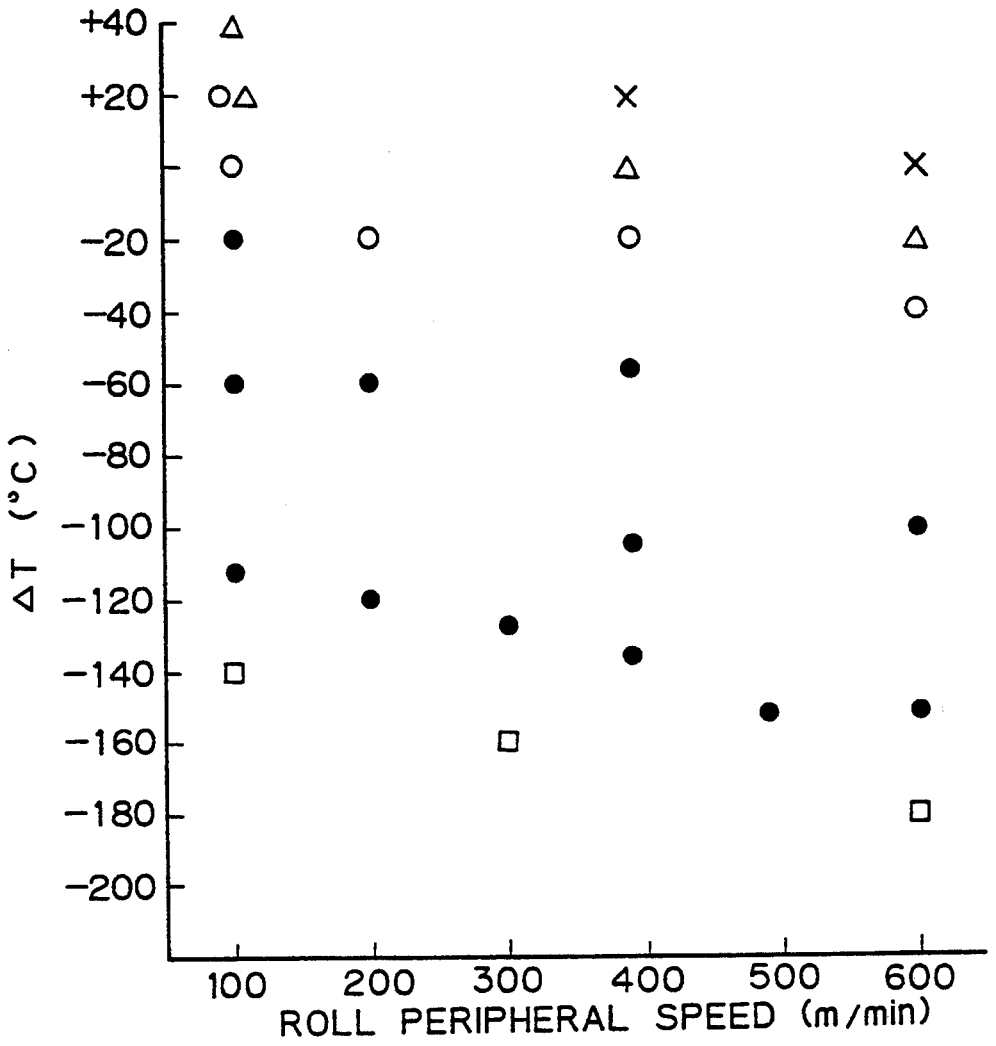
FIG. 9 is a graph showing the occurrence of a molten metal splash as a function of the roll surface temperature and the roll peripheral speed.

To solve this problem, the temperature of a coating roll 2 is controlled to be not higher than the melting point of a molten metal, preferably by 150° C. at maximum, so that the molten metal applied on the coating roll 2 is partially solidified in the limited portion near the interface with the roll surface to form a self-supporting layer, which ensures good wettability of the subsequently applied molten metal therewith. The temperature of a coating roll is not naturally lowered, because the applied molten metal has a temperature above the melting point thereof. Accordingly, a forcible cooling is required to cool a coating roll 2 to a temperature below the melting point of the applied molten metal. This is achieved by flowing a coolant, such as water or a non -oxidizing gas, through the roll to effect a heat exchange and thereby withdraw heat from the roll. This prevents the occurrence of a molten metal splash even under a high speed revolution of a coating roll 2, regardless of the roll surface material. The effect obtained through these measures is shown in FIG. 9.

According to the present invention, the same effect is provided when a coating roll revolves either in the natural or reverse direction with respect to the strip travelling direction.

A reducing atmosphere may be advantageously used for cleaning the strip surface to be plated.

A steel strip on which a molten metal has been deposited is cooled by a spray of a non-oxidizing gas, air, or a water-air mixture to solidify the deposited metal and provide a molten metal-plated steel strip.

It is also possible to produce a steel strip plated on both sides by using a pair of coating rolls disposed on both sides of a steel strip to be plated and effecting a simultaneous plating of both sides.

Figure 10:
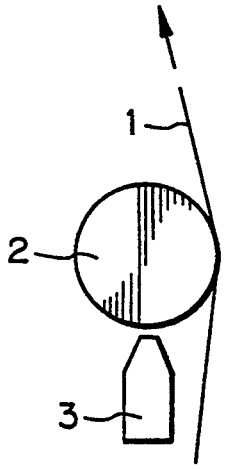
FIGS. 10(*a*) and 10(*b*) show arrangements for (a) one side plating and (b) both side plating.
Figure 10:
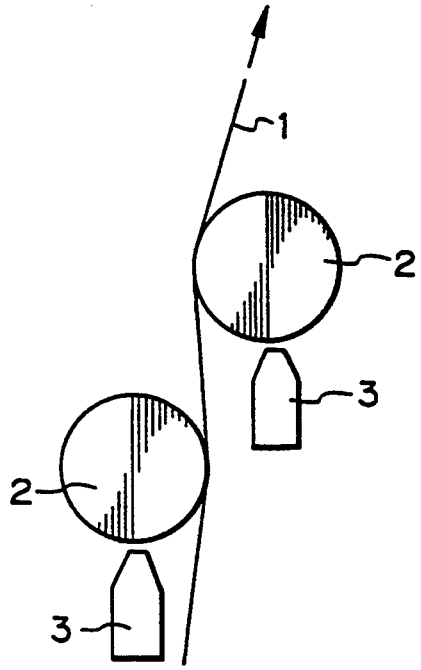

FIGS. 10(*a*) and 10(*b*) show arrangements for carrying out (a) a one side-plating and (b) a both sideplating, respectively.

In a continuous plating process, steel strips from separate coils are bonded together, usually by welding, to form a joint portion having a thickness several times greater than the strip thickness. The joint portion damages a coating roll 2 when passing thereon. To avoid this, a coating roll 2 may be provided with an instant refuge mechanism, which may be automatically operated by a tracking signal from the weld joint.

Good wettability between a steel strip and a molten metal is essential to ensure an adhesive plating, and accordingly, the steel strip surface to be plated must be sufficiently clean. The cleaning of the strip surface can be effected by a conventional cleaning method such as a pre-treatment by heating in a reducing atmosphere, degreasing, pickling, etc., or an application of a flux.

A steel strip to be plated is heated to a temperature near the melting point of a molten metal, as is usually effected in the conventional methods of molten metal plating.

EXAMPLE 1

Figure 11:
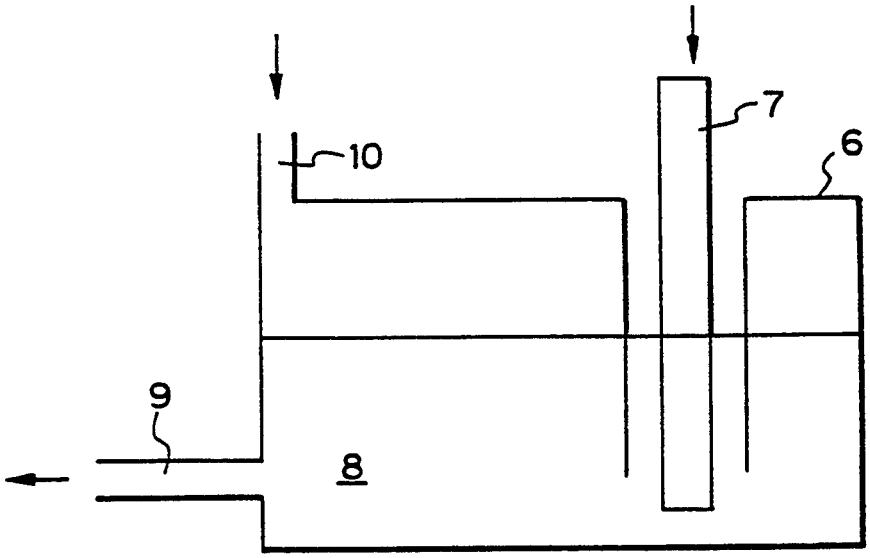
FIG. 11 shows an arrangement for continuously supplying a molten metal.

FIG. 2 shows an arrangement for carrying out a method according to the present invention. A steel strip 1 was surface-cleaned by heating in a reducing atmosphere. A flat coating roll 2 is in contact with the steel strip and a plating nozzle 3 is disposed near the coating roll 2 and located below the roll 2 at a distance of 0.5 mm. A molten metal ejecting slit 4 has an opening width of 2 mm measured at the nozzle tip. The mutual positions of the nozzle 3 and the roll 2 are as shown in FIG. 8(*a*). The roll 2 and the nozzle 3 are made of chromium oxide. As shown in FIG. 11, a molten metal 8 is supplied to the nozzle 3 from a melting pot 6 in which a solid metal stock 7 is continuously fed to generate a head pressure facilitating the molten metal supply. FIG. 11 also shows a molten metal supply port 9 and a gas introduction port 10 to be used when a gas pressurization is effected. The solid stock 7 is fed to the pot 6 at a speed cancelling the molten metal consumption in the pot 6 so that a molten metal is supplied to the deposition site on the strip surface at a desired rate.

A 500 mm wide, 0.8 mm thick steel strip was molten zinc-plated at a deposition thickness of 20 μm and at a strip travelling speed of 400 m/min, according to the present invention. The atmosphere gas in the plating apparatus was a mixture of 15% hydrogen gas and the balance of nitrogen. The atmosphere gas was ejected from the nozzle 3 at a header pressure of 0.25 kgf/cm$^2$. The strip was maintained at a temperature of 450° C. and the coating roll 2 was maintained at a temperature of 350° C., during plating.

After the deposition of the molten metal, the strip was held at that temperature for 1 min, then cooled by the ambient air until the deposited metal was solidified, and water-cooled to room temperature.

The thus-produced plated steel stirip had a fine and uniform appearance and an alloyed layer formed at the interface between the deposited metal and the base steel had a thickness of one tenth of that obtained by the conventional method.

EXAMPLE 2

The arrangement shown in FIG. 2 was used. A steel strip 1 is surface-cleaned by heating in a reducing gas atmosphere. A gravure coating roll 2 is in contact with the strip 1 and a nozzle 3 is disposed near the coating roll 2. The gravure roll 2 has lattice-shaped cells having a mesh size of 75 division/inch and a cell depth of 135 μm. The coating roll 2 revolves in the same direction as that of the strip travel. The nozzle 3 is located below the coating roll 2 at a distance of 0.9 mm, as shown in FIG. 8(*a*). A slit of the nozzle 3 has an opening width of 0.9 mm at the nozzle tip. The coating roll 2 and the nozzle 3 are made of silicon nitride. As shown in FIG. 11, a molten metal 8 is supplied to the nozzle 3 from a melting pot 6 in which a solid metal stock 7 is continuously fed to generate a head pressure facilitating the molten metal supply. The solid stock 7 is fed to the pot 6 at a speed cancelling the molten metal consumption in the pot 6 so that a molten metal is supplied to the deposition site on the strip surface at a desired rate.

A 500 mm wide, 0.8 mm thick steel strip was molten zinc-plated at a deposition thickness of 20 μm and at a strip travelling speed of 400 m/min, according to the present invention. The atmosphere gas in the plating apparatus was a mixture of 15% hydrogen gas and the balance of nitrogen. The atmosphere gas was ejected from the nozzle 3 at a header pressure of 0.25 kgf/cm$^2$. The strip was maintained at a temperature of 450° C. and the coating roll 2 was maintained at a temperature of 400° C., during plating.

After the deposition of the molten metal, the strip was held at that temperature for 1 min, then cooled by the ambient air until the deposited metal was solidified, and water-cooled to room temperature.

The thus-produced plated steel strip had a fine and uniform appearance and an alloyed layer formed at the interface between the deposited metal and the base steel had a thickness of one tenth of that obtained by the conventional method.

EXAMPLE 3

A molten zinc-plating was carried out according to the present invention in the same sequence as in Example 2, except that the gravure roll 2 had a mesh size of 180 divisions/inch and a cell depth of 45 μm and the zinc deposition thickness was 5 μm.

A zinc-plated steel strip having a fine and uniform appearance was produced.

EXAMPLE 4

A molten aluminum-plating was carried out according to the present invention in the same sequence as in Example 3, except that the strip temperature was 650° C. and the roll temperature was 600° C. during plating and the aluminum deposition thickness was 5 μm.

An aluminum-plated steel strip having a fine and uniform appearance was produced.

EXAMPLE 5

A molten zinc-plating was carried out according to the present invention in the same sequence as in Example 2, except that the atmosphere gas ejection pressure varied along the roll width to ensure a uniform deposition thickness when the roll/nozzle gap fluctuates along the strip width or when the gap is increased at the roll edge portion because of a difference in thermal expansion properties.

A zinc-plated steel strip having a fine and uniform appearance over the strip width was produced.

COMPARATIVE EXAMPLE 1

A molten metal plating was carried out in the same sequence as in Examples 1, 2, 3 or 4, except that the ejection of a non-oxidizing gas was not effected.

The thus-plated steel strip did not have a uniform appearance but had stripes on the surface.

COMPARATIVE EXAMPLE 2

A molten metal plating was carried out in the same sequence as in Examples 1, 2, 3, 4 or 5, except that the roll and the nozzle were arranged as shown in FIG. 8(*b*).

A molten metal formed stripes on the roll surface and a uniform plating could not be performed.

COMPARATIVE EXAMPLE 3

A molten metal plating was carried out in the same sequence as in Examples 1, 2, 3, 4 or 5, except that the roll surface temperature was higher than the melting point of the molten metal.

When the roll peripheral speed was 50 m/min or greater, the molten metal splashed away from the roll surface and a plating could not be performed.

In the current process lines of molten aluminum or zinc plating, the production is increased mainly in automobile and architectural materials, and accordingly increased are the line speed, the height to which a plated strip is lifted out of a molten metal bath, and the construction cost. The increased kinds of products increases the process loss when switching the product kinds. The improvement of the product quality is also required such as the prevention of dross adhesion, uniform deposition, and good formability.

The present invention provides a method of molten metal plating, whereby the above-mentioned problems are simultaneously solved.

The present inventive method can be also applied in many other fields such as a high speed coating of an organic resin solution.

We claim:

1. Apparatus for molten metal plating comprising:

a) a revolving roll having a rolling surface coated with an oxide-, carbide-, or nitride-base ceramic material having resistance to erosion by said molten metal;

b) a nozzle having first and second openings, said nozzle being disposed so that said first opening is aligned with a central axis of said revolving roll, said second opening being located downstream and off center of said central axis of said revolving roll;

c) a source of molten metal; and d) means in fluid communication with said nozzle for supplying molten metal on said revolving roll through said first opening;

said second opening ejecting a non-oxidizing gas therethrough toward said revolving roll, said ejected gas acting upon a meniscus of said molten metal applied on said revolving roll to prevent an ambient atmospheric gas dragged by said revolving roll from being engulfed by the molten metal meniscus, to thereby ensure that the molten metal meniscus continuously extends over a strip to be brought into contact with said revolving roll for molten metal plating thereof.

2. The apparatus according to claim 1, wherein said first opening is in the form of a slit.

3. The apparatus according to claim 2, wherein said slit continuously extends within the nozzle along a strip width direction.

* * * * *